US008080224B2

(12) United States Patent
Takeda et al.

(10) Patent No.: US 8,080,224 B2
(45) Date of Patent: Dec. 20, 2011

(54) CATALYST FOR THE CONVERSION OF CARBON MONOXIDE

(75) Inventors: Hiroshi Takeda, Hayahoshi (JP); Troy L. Walsh, Louisville, KY (US); Jon P. Wagner, Louisville, KY (US)

(73) Assignee: Sud-Chemie Inc., Louisville, KY (US)

( * ) Notice: Subject to any disclaimer, the term of this patent is extended or adjusted under 35 U.S.C. 154(b) by 247 days.

(21) Appl. No.: 11/381,938

(22) Filed: May 5, 2006

(65) Prior Publication Data

US 2007/0259976 A1 Nov. 8, 2007

(51) Int. Cl.

| | |
|---|---|
| ***B01D 53/56*** | (2006.01) |
| ***B01D 53/94*** | (2006.01) |
| ***B01J 8/02*** | (2006.01) |
| ***B01J 38/04*** | (2006.01) |
| ***B01J 29/06*** | (2006.01) |
| ***B01J 27/13*** | (2006.01) |
| ***B01J 23/40*** | (2006.01) |
| ***C01B 21/00*** | (2006.01) |
| ***C01B 23/00*** | (2006.01) |
| ***C01B 25/00*** | (2006.01) |
| ***C01B 31/00*** | (2006.01) |
| ***C01B 33/00*** | (2006.01) |
| ***C01B 35/00*** | (2006.01) |

(52) U.S. Cl. ..... 423/213.2; 423/247; 502/34; 502/66; 502/230; 502/234; 502/300; 502/325; 502/326

(58) Field of Classification Search ..... 518/716, 518/714; 502/300, 325, 326, 34, 35, 63, 502/66, 230, 234, 330; 423/213.2, 247
See application file for complete search history.

(56) References Cited

U.S. PATENT DOCUMENTS

| | | | | |
|---|---|---|---|---|
| 3,615,164 | A | 10/1971 | Baker et al. | |
| 3,884,838 | A * | 5/1975 | Fleming et al. | 502/313 |
| 3,912,659 | A | 10/1975 | Brandenburg et al. | |
| 4,157,338 | A * | 6/1979 | Haag et al. | 518/715 |
| 4,157,989 | A * | 6/1979 | Antos | 502/230 |
| 4,341,664 | A | 7/1982 | Antos | |
| 4,448,711 | A | 5/1984 | Motojima et al. | |
| 4,490,481 | A | 12/1984 | Boitiaux | |
| 4,683,214 | A * | 7/1987 | Angevine et al. | 502/66 |
| 4,740,487 | A | 4/1988 | Matheson et al. | |
| 4,812,223 | A | 3/1989 | Hickey, Jr. et al. | |
| 4,927,525 | A | 5/1990 | Chu | |
| 5,166,370 | A | 11/1992 | Liotta, Jr. et al. | |
| 5,674,460 | A | 10/1997 | Plog et al. | |
| 6,017,840 | A | 1/2000 | Wu et al. | |
| 6,037,513 | A | 3/2000 | Chang et al. | |
| 6,096,934 | A | 8/2000 | Rekoske | |
| 6,168,772 | B1 | 1/2001 | Watanabe | |
| 6,183,895 | B1 | 2/2001 | Kudo et al. | |
| 6,190,430 | B1 | 2/2001 | Fukuoka et al. | |
| 6,299,994 | B1 | 10/2001 | Towler et al. | |
| 6,299,995 | B1 * | 10/2001 | Abdo et al. | 429/17 |
| 6,350,423 | B1 | 2/2002 | Aoyama | |
| 6,409,939 | B1 | 6/2002 | Abdo et al. | |
| 6,627,777 | B2 | 9/2003 | Rossi et al. | |
| 7,452,844 | B2 | 11/2008 | Hu et al. | |
| 7,615,295 | B2 * | 11/2009 | Isozaki et al. | 429/412 |
| 2001/0039759 | A1 | 11/2001 | Sato et al. | |
| 2003/0096700 | A1 | 5/2003 | Cavalli et al. | |
| 2005/0096211 | A1 * | 5/2005 | Takeda et al. | 502/66 |
| 2007/0259976 | A1 * | 11/2007 | Takeda et al. | 518/716 |
| 2008/0064770 | A1 | 3/2008 | Rytter et al. | |

FOREIGN PATENT DOCUMENTS

| | | |
|---|---|---|
| EP | 0338734 | 10/1989 |
| JP | 2000262899 | 9/2000 |
| JP | 2001017861 A | 1/2001 |
| JP | 2001149779 | 6/2001 |
| JP | 2001155755 | 6/2001 |
| JP | 2001239169 | 9/2001 |
| JP | 2002066321 A | 3/2002 |
| JP | 2002119862 | 4/2002 |
| JP | 2002126535 | 5/2002 |
| WO | 0222256 | 3/2002 |

OTHER PUBLICATIONS

Chin, P. "Preferential Oxidation of Carbon Monoxide on Structured Supports". Department of Chemical Engineering, Jun. 2004.*

* cited by examiner

*Primary Examiner* — Jerry Lorengo
*Assistant Examiner* — Jennifer Smith
(74) *Attorney, Agent, or Firm* — McDonnell Boehnen Hulbert & Berghoff LLP

(57) ABSTRACT

Use of a catalyst composition comprising a metal selected from the group consisting of ruthenium, rhodium, nickel and combinations thereof, on a support selected from the group consisting of a beta-zeolite, mordenite and faujasites, is taught for carbon oxide methanation reactions for fuel cells. Specifically, when a mixture of gases containing hydrogen, carbon dioxide, carbon monoxide, and water is passed over the catalyst in a reaction zone having a temperature below the temperature at which the shift reaction occurs and above the temperature at which the selective methanation of carbon monoxide occurs, the catalyst efficiently facilitates the selective hydrogenation of carbon monoxide using $H_2$ that is present in the reformate and reduces the concentration of the CO to levels equal to or less than about 50 ppm and demonstrates a carbon monoxide (CO) methanation selectivity of greater than about 50%.

18 Claims, No Drawings

CATALYST FOR THE CONVERSION OF CARBON MONOXIDE

CROSS-REFERENCE TO RELATED APPLICATIONS

The present application is related to U.S. application Ser. No. 10/740,144 filed on Dec. 18, 2003 and incorporated herein in its entirety by reference.

BACKGROUND OF THE INVENTION

The present invention is the use of a specific catalyst composition for carbon oxide methanation reactions for fuel cells. Specifically, when a mixture of gases containing hydrogen, carbon dioxide, carbon monoxide, and water is passed over the catalyst in a reaction zone having a temperature below the temperature at which the shift reaction occurs and above the temperature at which the selective methanation of carbon monoxide occurs, the catalyst efficiently facilitates the selective hydrogenation of carbon monoxide using $H_2$ that is present in the reformate and reduces the concentration of the CO to levels equal to or less than about 50 ppm and demonstrates a carbon monoxide (CO) methanation selectivity of greater than about 50%. This is a significant improvement over selective methanation catalysts of the prior art.

In a fuel cell, such as a Polymer Electrolyte Membrane Fuel Cell (PEMFC) stack, chemical energy of a fuel is converted into electrical energy. Typically, the fuel used is a hydrogen rich gas supplied to the fuel cell by a fuel processor. However, the gas from the fuel processor may further comprise unconverted hydrocarbon, water, carbon dioxide and carbon monoxide. The carbon monoxide, in particular, is detrimental to the PEMFC stack because the carbon monoxide can poison the noble metal electrodes utilized by the fuel cells, thereby reducing the electrical output.

Preferably, the CO concentration for a fuel cell feed should be at a level below about 100 ppm, and more preferably to a level of less than about 50 ppm. However, as received from the fuel processor, the CO concentrations may be in excess of about 1 wt %, thus requiring further reduction of CO concentration. Some typical methods for reducing the CO concentration include selective catalytic oxidation of CO, pressure swing adsorption, hydrogen separation by membrane, and selective methanation of CO.

Selective catalytic oxidation of CO (Eq. 1) is a well-known process for reducing the CO concentration for fuel cells. But, oxidation of hydrogen (Eq. 2) is a competitive reaction.

$$\tfrac{1}{2}O_2+CO\rightarrow CO_2 \qquad \text{Eq. 1}$$

$$\tfrac{1}{2}O_2+H_2\rightarrow H_2O \qquad \text{Eq. 2}$$

Thus, in order to maximize the concentration of hydrogen gas and minimize the concentration of carbon monoxide, it is necessary to have reaction conditions wherein Eq. 1 is favored over Eq. 2. One option for achieving this is to have a highly specific catalyst for the oxidation of carbon monoxide and to limit the oxygen concentration so that the oxygen is consumed primarily for the production of carbon dioxide. Theoretically, this is achievable, but in practice there are wide swings in the CO concentrations produced by the fuel processor and it can be difficult to adjust the oxygen input to track the CO concentration. Because the CO is more detrimental to the fuel cell than water, it is typical for excess oxygen to be fed into the reactor thereby essentially ensuring that the CO will be converted to $CO_2$. The disadvantage is that significant quantities of $H_2$ are converted to water by operating in this manner.

Pressure swing adsorption is an industrially proven technology, but it requires relatively high pressure operation. Thus, while this process may be effective for use in larger fuel cells, it is not practical at this time for smaller fuel cells.

Hydrogen separation by membrane is effective for separating hydrogen from carbon monoxide. But the process requires a substantial pressure drop to effect the separation, and the cost and durability of the membranes still must be proven.

Selective methanation (Eq. 3) is a process whereby carbon monoxide is reacted with hydrogen in the presence of a catalyst to produce methane and water and methanation of carbon dioxide is minimized. Commonly used in ammonia plants, total carbon oxide methanation is known to reduce carbon monoxide and carbon dioxide concentrations to levels as low as about 5 ppmv to 10 ppmv, and the industrial catalysts are not selective. However, in most fuel cell applications, the selective methanation reaction is accompanied by a reverse water-gas-shift reaction (Eq. 4), which also is generally facilitated by a catalyst. Thus, while the CO concentration is being reduced through methanation, additional carbon monoxide is formed from the carbon dioxide present to maintain the equilibrium of the water-gas-shift reaction.

$$CO+3H_2\rightarrow CH_4+H_2O \qquad \text{Eq. 3}$$

$$CO_2+H_2\leftrightarrow CO+H_2O \qquad \text{Eq. 4}$$

Under the proper reaction conditions and with a non-selective methanation catalyst, the $CO_2$ may be methanated as shown in Eq. 5.

$$CO_2+4H_2\rightarrow CH_4+2H_2O \qquad \text{Eq. 5}$$

But, this is generally an undesirable reaction because it further consumes $H_2$ and the $CO_2$ methanation is normally accompanied by a temperature rise in the reactor that can lead to "run-away" conditions. Considering that the carbon dioxide concentration is greater than 10 times that of carbon monoxide, achieving selectivity is not thermodynamically favorable. Thus, it would be advantageous to have a catalyst that is highly selective for CO methanation, essentially suppresses $CO_2$ methanation and does not facilitate the conversion of $CO_2$ to CO through the water-gas-shift reaction.

In the prior art methanation processes, precious metals supported on non-zeolitic materials, such as $Al_2O_3$, $SiO_2$, and $TiO_2$, have been used as catalysts in the selective methanation of CO (see, for example, U.S. Pat. No. 3,615,164 and U.S. Pat. Pub. No. 2003/0086866). For example, in WO 01/64337, ruthenium (Ru) on a carrier base support of $Al_2O_3$, $TiO_2$, $SiO_2$, $ZrO_2$, or $Al_2O_3$—$TiO_2$ with egg-shell structure is taught to reduce the CO to concentrations of about 800 ppm with 70-80% selectivity under an atmosphere of CO at 0.6%, $CO_2$ at 15%, $H_2$ at 64.4%, $H_2O$ at 20% and GHSV=10,000 $H^{-1}$. However, for an efficient PEMFC power system, the CO concentration should be less than about 100 ppm, and preferably equal to or less than about 50 ppm. Since the CO concentration from the selective methanation processes using the prior art catalysts are significantly higher than the desired maximum concentration for a PEMFC stack, these catalysts cannot be practically used in PEMFC power systems.

Thus, it would be advantageous to have a catalyst that is highly selective for CO methanation, essentially suppresses $CO_2$ methanation and does not facilitate the conversion of $CO_2$ to CO through the water-gas-shift reaction.

SUMMARY OF THE INVENTION

The present invention is the use of a catalyst comprising a metal that can form a metal-carbonyl species on a support having a regular lattice structure and a predetermined pore diameter of sufficient dimensions to accommodate the carbonylated metal species for carbon oxide methanation reactions for fuel cells. More specifically, the catalyst comprises a metal selected from the group consisting of ruthenium, rhodium, nickel and combinations thereof, on a support selected from the group consisting of a beta-zeolite, mordenite and faujasite. An inert binder, such as alumina, $\gamma$-$Al_2O_3$, $SiO_2$, $ZrO_2$, $TiO_2$ or pseudo-boehmite, may optionally be added to the catalyst.

When a mixture of gases containing hydrogen, carbon dioxide, carbon monoxide, and water is passed over the catalyst in a reaction zone having a temperature below the temperature at which the shift reaction occurs and above the temperature at which the selective methanation of carbon monoxide occurs, the catalyst efficiently facilitates the selective hydrogenation of carbon monoxide using $H_2$ that is present in the reformate and reduces the concentration of the CO to levels equal to or less than about 50 ppm and demonstrates a carbon monoxide (CO) methanation selectivity of greater than about 50%. This is a significant improvement over selective methanation catalysts of the prior art.

DETAILED DESCRIPTION OF THE PREFERRED EMBODIMENT

Carbon oxide methanation reactions in small fuel cells can be facilitated by using a catalyst having a predetermined pore size of sufficient dimensions to allow the pore to accommodate a fully carbonylated metal complex. The methanation reaction is a process for reducing the quantity of carbon monoxide in a mixture of gases containing hydrogen and carbon monoxide. The process of the present invention comprises passing a feedstream containing gases selected from hydrogen, carbon dioxide, carbon monoxide, water and combinations thereof over the catalyst in a reactor reaction zone at a temperature of from about 150° C. to about 300° C. and at a gas flow rate of from about 2,000 vol/vol/hr to about 40,000 vol/vol/hr. More specifically, the catalyst comprises a metal selected from the group consisting of ruthenium, rhodium, nickel and combinations thereof, on a support selected from the group consisting of a beta-zeolite, mordenite and faujasite. Optionally, the catalyst may comprise an inert binder, such as a binder selected from the group consisting of alumina, $\gamma$-$Al_2O_3$, $SiO_2$, $ZrO_2$, $TiO_2$, pseudo-boehmite, and combinations thereof.

As is known in the art, some typical supports for catalysts are crystalline alumino-silicate materials. Among the metals known in the art to form stable metal-carbonyl complexes are ruthenium, rhodium, nickel, iron, cobalt, rhenium, palladium, lead and tin, as an exemplary group. Optionally, an inert binder, such as alumina, $\gamma$-$Al_2O_3$, $SiO_2$, $ZrO_2$, $TiO_2$ or pseudo-boehmite, may optionally be added to the catalyst.

The present invention will be described herein through, without limitation, exemplary embodiments, figures and examples. Any embodiments, figures, examples and related data presented herein are merely to exemplify the principles of the invention, and are not intended to limit the scope of the invention.

The support of the catalyst of the present invention comprises a crystalline alumino-silicate having a predetermined pore size. More specifically, the crystalline alumino-silicate can be a molecular sieve, beta-zeolite, mordenite, faujasite or any other alumino-silicate with a regular lattice structure. Other supports that also have regular lattice structures and essentially consistent pore sizes that may be used in place of the alumino-silicate for the catalyst of the present invention include alumina, titania, ceria, zirconia and combinations thereof. Because it is believed that the methanation reaction occurs within the support pore, the pore must be of sufficient dimensions to accommodate a fully carbonylated metal complex, and thus, the pore size requirement will vary depending on the metal species selected for the catalyst. However, it has generally been observed that if the pore size is smaller than or is significantly larger than the dimensions of the fully carbonylated metal species, the resulting catalyst does not show the desired selectivity for carbon monoxide methanation.

The metal of the catalyst of the present invention must be capable of forming a metal-carbonyl species. As is known in the art, metals may form metal-carbonyl complexes wherein each ligand is a carbonyl unit, such as $Fe(CO)_5$, or metals may form metal-carbonyl complexes wherein at least one ligand is not a carbonyl, such as $CpFe(CO)_3$. For the purpose of the development, it is not necessary that the metal be capable of forming a fully-carbonylated complexes, e.g. wherein each ligand is a carbonyl group. Rather, a "fully-carbonylated" complex—for the purpose of calculating the volume needed within the support pore—is defined herein as the metal complex with the maximum number of carbon monoxide ligands that the metal prefers to accommodate in its lowest energy state. The metal is preferably selected from the group consisting of ruthenium, rhodium, platinum, palladium, rhenium, nickel, iron, cobalt, lead, tin, silver, iridium, gold, copper, manganese, zinc, zirconium, molybdenum, other metals that form a metal-carbonyl species and combinations thereof. As delivered to the catalyst, the metal may be a base metal or it may be a metal oxide complex.

The metal may be added to the support by any means known in the art for intercalating the metal into the support pores, such as, without limitation, impregnation, incipient wetness method, immersion and spraying. The embodiments presented herein add the metal through impregnation for exemplary purposes only. Although not a requirement to practice the invention, it is recommended that the metal source be free of typically recognized poisons, such as sulfur, chlorine, sodium, bromine, iodine or combinations thereof. Acceptable catalyst can be prepared using metal sources that include such poisons, but care must be taken to wash the poisons from the catalyst during production of the catalyst.

In an embodiment of the present invention, the support is a crystalline alumino-silicate selected from mordenite, beta-zeolite or faujasite. The support has a pore diameter of greater than about 6.3 Å, and a pore volume in the range of from about 0.3 $cm^3/g$ to about 1.0 $cm^3/g$, and preferably in the range of 0.5 $cm^3/g$ to about 0.8 $cm^3/g$. Ruthenium is impregnated on the support so as to deliver a concentration of from about 0.5 wt % Ru to about 4.5 wt % Ru, based on the total weight of the catalyst including the ruthenium. Some recommended sources of ruthenium include, without limitation, $Ru(NO)(NO_3)_x(OH)_y$, $Ru(NO_2)_2(NO_3)_2$, $Ru(NO_3)_3$, $RuCl_3$, $Ru(CH_3COO_3)$, $(NH_4)_2RuCl_6$, $[Ru(NH_3)_6]Cl_3$, $Ru(NO)Cl_3$, and $Ru_3(CO)_{12}$. Optionally, the catalyst further comprises the binder $\gamma$-$Al_2O_3$ at a loading of about 20 wt %, including the weight of the binder.

The catalyst may be used in an exemplary process for removing or substantially reducing the quantity of carbon monoxide in a mixture of gases containing hydrogen, carbon dioxide, carbon monoxide, and water. For example, an exemplary feedstream comprises hydrogen at a concentration of from about 30% to about 80%, preferably from about 40% to about 70%, on a dry gas basis; $CO_2$ at a concentration of from about 0.1% to about 25%, preferably from about 0.25% to about 17%, on a dry gas basis; CO at a concentration of from about 0.1% to about 1.0%, preferably from about 0.25% to about 0.75%, on a dry gas basis; and $H_2O$ at a concentration of from about 0.5% to about 50%, and preferably from about 5.0% to about 35%. The process of the present invention comprises passing a feedstream containing gases selected from hydrogen, carbon dioxide, carbon monoxide, water and combinations thereof over the catalyst in a reactor reaction zone at a temperature of from about 150° C. to about 300° C., and preferably from 175° C. to about 250° C. In this temperature range, the catalyst efficiently facilitates the selective hydrogenation of carbon monoxide using $H_2$ that is present in the reformate and reduces the concentration of the CO to levels equal to or less than about 50 ppm and demonstrates a carbon monoxide (CO) methanation selectivity of greater than about 50%. The process is preferably carried out at a gas flow rate—as defined as the volumetric flow rate at standard temperature and pressure (0 C, 1 atm) divided by the catalyst volume (Space Velocity)—of from about 2,000 vol/vol/hr to about 40,000 vol/vol/hr, and preferably from about 5,000 vol/vol/hr to about 10,000 vol/vol/hr. The pressure may range from about 1 atm to about 50 bar.

It is understood that variations may be made which would fall within the scope of this development. For example, although the catalysts of the present invention are intended for use as selective methanation catalysts for the conversion of carbon monoxide for fuel cell applications, it is anticipated that these catalysts could be used in other applications requiring highly selective carbon oxide methanation catalysts.

What is claimed is:

1. A process for the selective hydrogenation of carbon monoxide so as to reduce the concentration of carbon monoxide in a reformate feed stream containing a mixture of hydrogen, carbon monoxide, carbon dioxide and water, thereby forming a hydrogen-rich gas suitable for use as fuel for a fuel cell, the process comprising:

a) providing a selective CO hydrogenation catalyst in a reactor wherein the catalyst consists essentially of a metal selected from the group consisting of ruthenium, rhodium, nickel and combinations thereof, on a support selected from the group consisting of beta-zeolite, mordenite, and faujasite, wherein the support has a pore diameter greater than about 6.3 Å, the diameter further having an upper limit that is defined by the structure of the beta-zeolite, mordenite or faujasite used as the support;

b) passing a reformate feed stream containing gases of hydrogen, carbon dioxide, carbon monoxide, water and combinations thereof over the catalyst at a temperature at which selective methanation occurs up to about 300° C. and at about 2,000 vol/vol/hr to about 40,000 vol/vol/hr; and c) producing a hydrogen-rich exit stream suitable for use as fuel for a fuel cell in which the carbon monoxide concentration is equal to or less than about 100 ppm.

2. The process of claim 1 wherein the carbon monoxide concentration in the exit stream is about 50 ppm.

3. The process of claim 1 wherein in step b), the passing of the feed stream over the catalyst is at a temperature of up to about 250° C.

4. The process of claim 1 wherein step a) further includes selecting a support that has a pore size that will accommodate a fully-carbonylated metal complex for the selected metal.

5. The process of claim 1 wherein the selected metal is ruthenium and the support is mordenite, and step a) further includes impregnating the Ru metal on the mordenite support in a concentration of about 0.5 wt % to about 4.5 wt %, based on the total weight of the catalyst including the ruthenium.

6. The process of claim 1 wherein the selected metal is rhodium and the support is mordenite.

7. The process of claim 1 wherein the catalyst further comprises an inert binder selected from the group consisting of alumina, $\gamma$-$Al_2O_3$, $SiO_2$, $ZrO_2$, $TiO_2$ or pseudo-boehmite.

8. A process for the selective methanation of carbon monoxide so as to reduce the concentration of carbon monoxide in a feed stream containing a mixture of hydrogen, carbon monoxide, carbon dioxide and water, thereby forming a hydrogen-rich gas suitable for use as fuel for a fuel cell, the process comprising:

a) providing a selective CO methanation catalyst in a reactor wherein the catalyst comprises a metal selected from the group consisting of ruthenium, rhodium, nickel and combinations thereof, on a support selected from the group consisting of beta-zeolite, mordenite, and faujasite, wherein the support has a pore diameter greater than about 6.3 Å, the diameter further having an upper limit that is defined by the structure of the beta-zeolite, mordenite or faujasite used as the support;

b) passing a feed stream containing gases of hydrogen, carbon dioxide, carbon monoxide, water and combinations thereof over the catalyst at a temperature at which selective methanation occurs up to about 250° C. and at about 2,000 vol/vol/hr to about 40,000 vol/vol/hr; and c) producing a hydrogen-rich exit stream suitable for use as fuel for a fuel cell in which a carbon monoxide methanation selectivity of about 50% or greater is achieved.

9. The process of claim 8 wherein step a) further includes selecting a support that has a pore size that will accommodate a fully-carbonylated metal complex for the selected metal.

10. The process of claim 8 wherein the selected metal is ruthenium and step a) further includes impregnating the Ru metal on the support in a concentration of about 0.5 wt % to about 4.5 wt %, based on the total weight of the catalyst including the ruthenium.

11. The process of claim 8 wherein the selected metal is rhodium and the support is mordenite.

12. The process of claim 8 wherein the catalyst further comprises an inert binder selected from the group consisting of alumina, $\gamma$-$Al_2O_3$, $SiO_2$, $ZrO_2$, $TiO_2$ or pseudo-boehmite.

13. A process for the selective methanation of carbon monoxide so as to reduce the concentration of carbon monoxide in a feed stream containing a mixture of hydrogen, carbon monoxide, carbon dioxide and water, thereby forming a hydrogen-rich gas suitable for use as fuel for a fuel cell, the process comprising:

a) providing a selective CO methanation catalyst in a reactor wherein the catalyst comprises a metal selected from the group consisting of ruthenium, rhodium, nickel and combinations thereof, on a support selected from the group consisting of beta-zeolite, mordenite, and faujasite, wherein the support has a pore diameter greater than about 6.3 Å, the diameter further having an upper limit that is defined by the structure of the beta-zeolite, mordenite or faujasite used as the support;

b) passing a feed stream containing a mixture of gases of hydrogen, carbon dioxide, carbon monoxide, water and combinations thereof over the catalyst at a temperature at which selective methanation occurs up to about 250° C. and about 2,000 vol/vol/hr to about 40,000 vol/vol/hr; and c) producing a hydrogen-rich exit stream suitable for use as fuel for a fuel cell in which the methanation of carbon monoxide is highly selective such that the methanation of carbon dioxide is suppressed and the conversion of carbon dioxide to carbon monoxide through the reverse water-gas-shift reaction is minimized.

14. The process of claim 13 wherein step a) further includes selecting a support that has a pore size that will accommodate a fully-carbonylated metal complex for the selected metal.

15. The process of claim 13 wherein the selected metal is ruthenium.

16. The process of claim 13 wherein the catalyst further comprises an inert binder selected from the group consisting of alumina, $\gamma$-$Al_2O_3$, $SiO_2$, $ZrO_2$, $TiO_2$ or pseudo-boehmite.

17. The process of claim 15 wherein step a) further includes impregnating the Ru metal on the support in a concentration of about 0.5 wt % to about 4.5 wt %, based on the total weight of the catalyst including the ruthenium, and the support is mordenite.

18. The process of claim 13 wherein the selected metal is rhodium and the support is mordenite.

* * * * *